US006308605B1

(12) United States Patent
Rau et al.

(10) Patent No.: US 6,308,605 B1
(45) Date of Patent: Oct. 30, 2001

(54) CROSSCUTTER FOR WEB MATERIALS

(75) Inventors: Jürgen Rau, Bempflingen; Hansjörg Klein, Aichwald, both of (DE)

(73) Assignee: Bielomatik Leuze GmbH & Co. (DE)

( * ) Notice: Subject to any disclaimer, the term of this patent is extended or adjusted under 35 U.S.C. 154(b) by 0 days.

(21) Appl. No.: 09/425,620

(22) Filed: Oct. 22, 1999

(30) Foreign Application Priority Data

Oct. 23, 1998 (DE) ..... 198 48 973

(51) Int. Cl.[7] ..... B26D 1/62
(52) U.S. Cl. ..... 83/663; 83/698.41; 83/331
(58) Field of Search ..... 83/663, 665, 698.41, 83/698.11, 659, 331

(56) References Cited

U.S. PATENT DOCUMENTS

| | | | | |
|---|---|---|---|---|
| 3,908,499 | * | 9/1975 | Reed | 83/665 |
| 4,131,047 | | 12/1978 | Schriber et al. . | |
| 4,143,568 | * | 3/1979 | Cogswell | 83/116 |
| 4,183,271 | | 1/1980 | Martin . | |
| 4,187,753 | * | 2/1980 | Walde | 83/674 |
| 4,253,363 | * | 3/1981 | Fram | 83/114 |
| 4,280,386 | * | 7/1981 | Ward, Sr. | 83/500 |
| 4,364,293 | * | 12/1982 | Hirsch | 83/674 |
| 4,392,402 | | 7/1983 | Rann . | |
| 4,594,926 | * | 6/1986 | Propheter | 83/345 |
| 4,646,603 | * | 3/1987 | Held | 83/425.4 |
| 4,854,204 | * | 8/1989 | Faltin | 83/500 |
| 4,881,436 | | 11/1989 | Rommel . | |
| 4,911,047 | * | 3/1990 | Hornung et al. | 83/342 |
| 5,107,737 | * | 4/1992 | Tagliaferri | 83/665 |
| 5,161,442 | * | 11/1992 | Rilitz et al. | 83/117 |
| 5,357,831 | * | 10/1994 | Michalik | 83/347 |
| 5,419,224 | | 5/1995 | Gamperling et al. . | |
| 5,447,086 | * | 9/1995 | Wittmaier et al. | 83/666 |
| 5,493,940 | * | 2/1996 | Klein | 83/343 |
| 5,529,450 | | 6/1996 | Mesolella . | |
| 5,638,733 | * | 6/1997 | Brazzo | 83/698.41 |
| 5,662,018 | * | 9/1997 | Klein | 83/343 |
| 5,782,156 | * | 7/1998 | Collins | 83/331 |
| 5,979,282 | * | 11/1999 | Schlatter et al. | 83/425.4 |
| 6,065,382 | * | 5/2000 | Titz et al. | 83/341 |

FOREIGN PATENT DOCUMENTS

| | | |
|---|---|---|
| 29 22 164 | 12/1980 | (DE) . |
| 36 08 111 | 12/1986 | (DE) . |
| 89 00 516 | 1/1989 | (DE) . |
| 89 15 512 | 8/1989 | (DE) . |
| 43 21 163 | 1/1995 | (DE) . |
| 195 45 003 | 6/1997 | (DE) . |
| 1 571 759 | 7/1980 | (GB) . |
| WO 96/06791 | 3/1996 | (WO) . |

* cited by examiner

*Primary Examiner*—Rinaldi I. Rada
*Assistant Examiner*—Kim Ngoc Tran
(74) *Attorney, Agent, or Firm*—Akerman Senterfitt

(57) ABSTRACT

A crosscutter for web materials, particularly paper, has a cutter shaft (13), which comprises a light metal cutter block (19) and a steel shaft end (14). The latter comprises a bearing (12) and drive (17)-receiving spigot and a flange (16), which is connected by means of a positive and nonpositive connection to the cutter block. For nonpositive connection purposes threaded bolts (35) are inserted in bushes (33), which are screwed and bonded into corresponding cutter block recesses. In addition, a reamed bolt connection is provided.

14 Claims, 5 Drawing Sheets

CROSSCUTTER FOR WEB MATERIALS

BACKGROUND OF THE INVENTION

The invention relates to a crosscutter for web materials, particularly paper.

DE-U-89 00 516 discloses a crosscutter for corrugated paper or board, which has a cutter block in the form of a composite carbon fibre material tube, to which is fitted by means of screws a cutter beam or support. Bearing and driving take place by means of metallic bearing stubs, which are incorporated into the tube.

DE-A-195 45 003 discloses a cutter shaft, which has an outer shell of a hollow metal section, particularly aluminium and which passes round an inner shell of a composite fibre material, where the cutter beam is constructed in the outer shell. For bearing and mounting purposes shaft journals are fixed in torsionally and fluxurally stiff manner.

In order to be able to cut different formats or sizes with crosscutters and without changing the cutter shaft, it is e.g. known from DE-C-36 08 111 to nonuniformly drive the cutter shafts using unbalance gears or preferably controllable electric motors with high accelerating and decelerating moments. The speed of the cutter shafts is decelerated during a revolution for cutting a format longer than the synchronous format determined by the circumference of the cutter shafts and at the time of cutting is reaccelerated to the web speed. It is also possible by periodic acceleration to a circumferential speed above the web speed to cut formats shorter than the synchronous format. The angle values of the requisite cut lengths and the possible accelerating and decelerating values determine the synchronous cut length, i.e. the cutter shaft diameter.

OBJECT OF THE INVENTION

An object of the invention is to provide a crosscutter for web materials, which has a considerable variation scope with respect to the synchronous cut length and satisfies all the requirements with respect to the construction, particularly the cutter shaft fitting, the possibility of applying enormous torques and having an adequate torsional and flexural stiffness or rigidity for the cutter shaft.

SUMMARY OF THE INVENTION

As a result of a very favourable shaft cross-section, the light metal cutter block compensates the lower modulus of elasticity compared with steel with respect to the torsional and flexural rigidities. Compared with a lightweight construction using composite carbon fibre materials (CFKs), it simultaneously permits a direct fitting of the cutter to the cutter block, which would not be possible with CFKs. In the case of a conventional steel cutter shaft construction, due to the high mass moment of inertia it is not possible to apply the accelerations and decelerations occurring due to the required divergences from the synchronous cut length. This more particularly applies for the presently preferred large crosscutters with a web speed of up to 400 m/min.

Large synchronous cut lengths do not cause a problem for the cutter shaft according to the invention. However, it can also be used for smaller synchronous cut lengths than the conventional lengths, e.g. of 500 mm. With the conventionally required web widths of approximately 2,000 mm, a cutter shaft with a single cutter on the circumference would only have a travel circle diameter of approximately 160 mm, which would not be possible in the earlier arrangements and materials due to the necessary flexural rigidity. Thus, in the case of the cutter shaft according to the invention it is possible to choose a form with two cutters on the circumference, which bring the cutter shaft to twice the diameter, which does not permit adequate acceleration values in conventional steel cutter shafts due to the then high mass moment of inertia.

This is possible, particularly because the cutter beam or support can be directly incorporated into the light metal cutter shaft, so that the external diameter important for the torsional and flexural rigidity need only be slightly smaller than the cutter travel circle. In the case of CFK cutter shafts, which would intrinsically appear suitable for such extreme conditions, for stability reasons steel cutter beds would be required and which as a result of the large cutter travel circle give rise to an excessive mass moment of inertia and whose fixing to the cutter block is problematical and weakens the latter.

The peak values of the driving torque and the corresponding braking moment are at approximately 5,000 Nm. Cutting force-caused bending moments must also be absorbed. These forces require a firm, secure seating of the shaft bearings and the synchronous gears transferring the drive. This is unachievable with a shaft end construction made from the cutter block material, i.e. light metal, particularly aluminium alloy. Thus, in the invention the shaft ends are made from a high strength material, particularly steel. The difficultly solvable problem of the fixing between the light metal cutter block and the steel shaft ends requires special measures, which in the case of the invention are formed by the flange, which extends over the entire circumference of the cutter block and ensures a positive and/or nonpositive connection. Particular preference is given to a both positive and nonpositive connection, in which in particular both connection types are such that they can alone transfer the driving torque. Although it is preferable to provide the construction of the shaft end with flange at both ends of the cutter shaft, in a one-sided arrangement of the drive only the drive-side shaft end need be connected in this way, because there, in addition to the bending moments, the driving moment must also be transferred.

The connection between the flange and the substantially cylindrical cutter block can take place nonpositively by frictional grip. For this purpose it is possible to insert in the circular cylindrical recesses, which can continue in bores or holes extending longitudinally over the cutter block, bushes with a particularly well-fitting, low-backlash screw thread and can optionally also be bonded therein. Into said bushes can be screwed fixing screws, which press the flange onto the end face of the cutter block. For an optimum force closure and to secure against the loosening of the bushes, the end face of the cutter block can be positioned somewhat lower than the latter, so that the flange only engages on the end face of the cutter block and not on those of the bushes. Through the choice of a fine thread between the bushes and the cutter block there is a self-locking action thereof under force. The transfer of the considerable screw forces consequently takes place in very large-area manner on the less strong material of the cutter block. This would scarcely be possible with a direct screwing in of the fixing screws.

The cutter block preferably has several recesses for reamed bolts, which are also distributed over the circumference and which are fitted therein and into the flange and optionally secured by locking screws. They form a positive connection.

The construction of the shaft ends with shaped-on flange consequently permits a very large-area transfer of the forces.

Very high contact pressures must act with a nonpositive transfer. They can be applied to a very large surface area, so that despite the high screw forces there is no need to fear overstressing of the light metal material. These frictional forces act due to the fact that substantially the entire circumference (except for the cutter beam recesses) is available for frictional force transfer, whereas the end face portions made from another material, such as the area of the bushes, are set back with respect to the aluminium end face and cannot disturb the frictional force transfer.

Particularly as a result of the combination of the frictional grip and reamed bolts, i.e. through a simultaneous positive and nonpositive connection, an operationally reliable force transfer is possible in this particularly critical case of a connection between two parts of a cutter shaft. The nonpositive transfer ensures that it is completely backlash-free, because it could otherwise work loose. The self-closure by the reamed bolts ensures security on releasing the frictional grip and simultaneously relieves the latter without impairing it.

It is particularly advantageous that the different connecting elements on the cutter block, i.e. the bush recesses and the reamed bolt recesses, as well as the through central bore, which preferably receives a spigot, can be positioned in such a way that a profile with an extremely flexurally and torsionally rigid configuration for the cutter block is obtained. If e.g. the four bush recesses are uniformly distributed round the circumference with between each pair thereof a cutter beam recess and the recesses for the reamed bolts were displaced by approximately 90° and close to the circumference, then not only as a result of the relatively large circumferential spacing would the self-closure and frictional grip transfer be favourable, but a spoke-like structure of the cutter block would be obtained with a through, supporting cross-section in the outer area and an inner cross-spoke structure, oriented in such a way that it is self-balanced, in that the individual recesses are distributed relatively uniformly over the circumference. One of the spokes is roughly in the connection of two cutter beams, so that as a result of these the bending forces acting on the cutter can be absorbed.

These and further features can be gathered from the claims, description and drawings and the individual features, either alone or in the form of sub-combinations, can be implemented in an embodiment of the invention and in other fields and can represent advantageous, independently protectable constructions for which protection is hereby claimed. The subdivision of the application into individual sections and the subtitles in no way restrict the general validity of the statements made thereunder.

BRIEF DESCRIPTION OF THE DRAWINGS

An embodiment of the invention is described in greater detail hereinafter relative to the attached drawings, wherein show.

DETAILED DESCRIPTION OF A PREFERRED EMBODIMENT

A cutter shaft 13 is mounted in bearings 12 in a crosscutter 11, whereof only part of the casing is shown and which is a so-called folio crosscutter. In conjunction with a corresponding, i.e. substantially identically constructed countercutter, it cuts from a web, which can comprise layers from different paper rolls, relatively large paper sheets, which are subsequently collected e.g. in reams or stacks on pallets.

Figure 1:
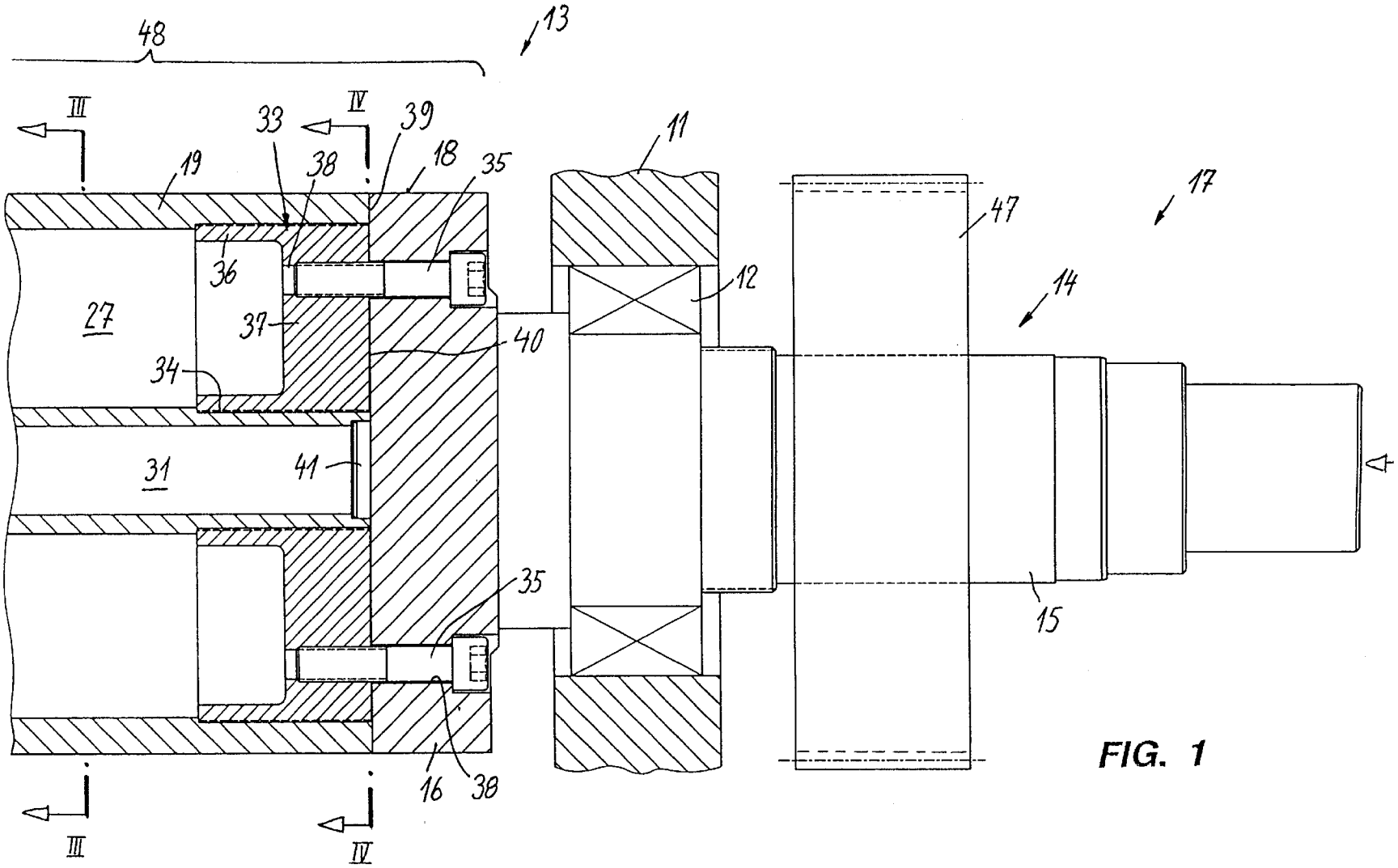
FIG. 1 A partial longitudinal section through a cutter shaft.
Figure 2:
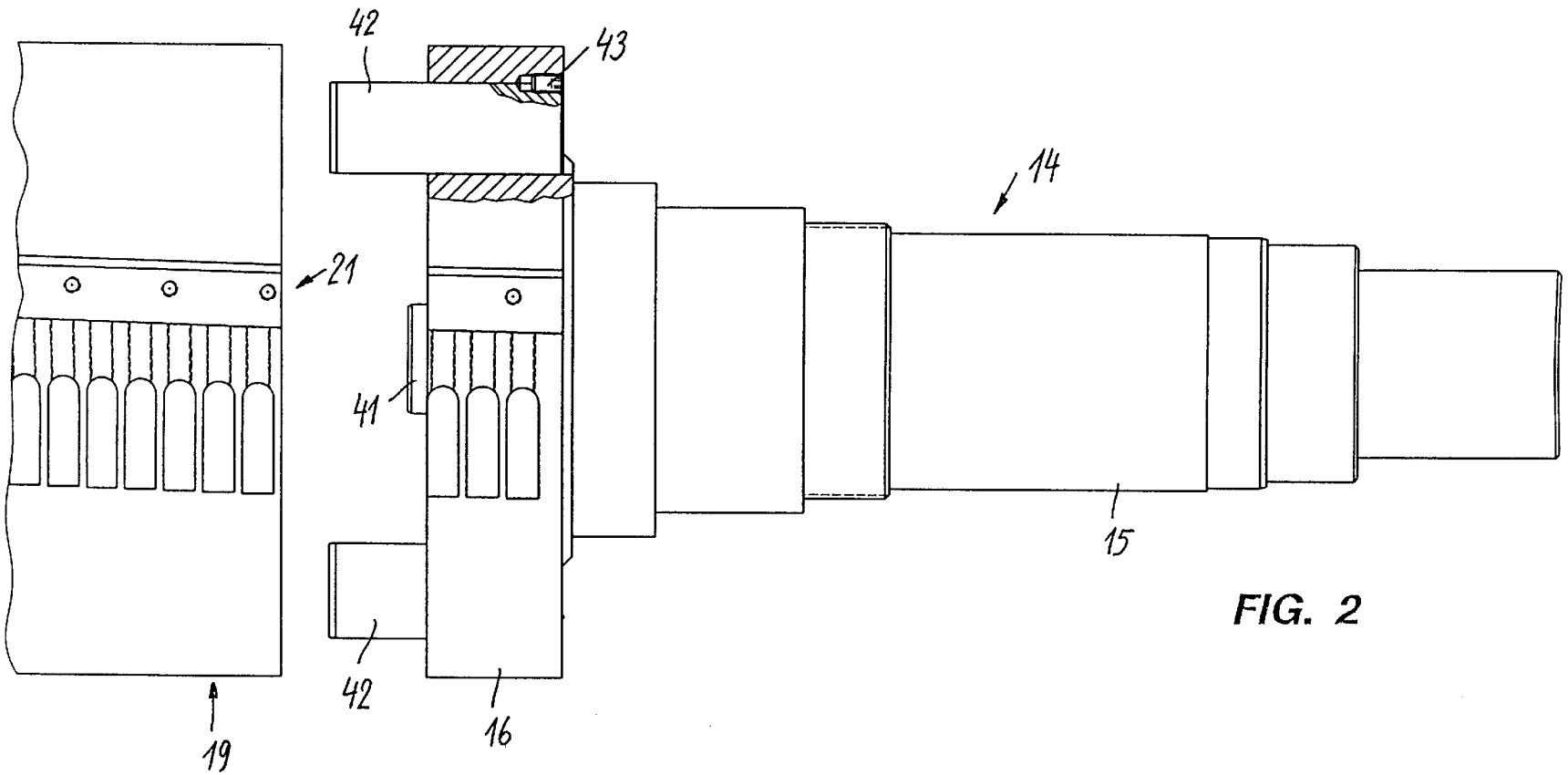
FIG. 2 A part sectional side view of the same section, but displaced by 90°.

On the shaft end 14 of the cutter shaft 13, which comprises a multistepped journal 15 and a flange 16 in one piece therewith (cf. FIGS. 1 and 2) acts a drive 17, to which belongs a synchronous gear 47, which is fitted in non-rotary manner on the journal. This gear meshes with a corresponding synchronous gear of the cutter shaft cooperating with the cutter shaft 13 shown. Generally synchronous gears are provided on both ends of a cutter shaft. The drive by the drive motors can either take place directly on the shaft journals 15 or by means of the synchronous gear. Generally in the case of such large crosscutters, the drives are in the form of directly flanged, controlled electric motors, which are able to accelerate themselves and the cutter shaft in fractions of a revolution to a speed corresponding to the web speed and then to decelerate therefrom to a lower speed or to the stationary state.

The cutting area 48 of the cutter shaft extends up to the journal-side end of the flange 16 and up to there the outer circumference 18 of the flange forms the direct continuation of the surface of a cutter block 19, which takes up most of the cutting area. The cutter block comprises a circular cylindrical portion of an aluminium alloy (cf. FIG. 3), in whose outer circumference are provided facing recesses 20 in the form of roughly longitudinally directed grooves for cutter beams 21 for fitting the cutter 22 fixed with a slight slope with respect to the axis. Fixing takes place by means of a chucking wedge 23, which fixes the cutter in the area of its base thickening away from the blade. The chucking wedge 23 is drawn by means of screws 53 into the cross-sectionally inwardly tapering, trapezoidal recesses 20. On the side facing the cutter 22 the recess 20 (cutter groove) is lined with a steel strip 54, which ensures a uniform distribution of the contact pressure without plastic deformation.

The setting of the cutter, which is important for a precise cut, takes place by means of a plurality of juxtaposed, roughly tangentially directed adjusting screws 24, which are screwed into corresponding tapholes 25 in the cutter block 19. The cutter beam recesses 20 and the cutter 22 also extend over and beyond the flange outer circumference, so that the latter forms an active part of the cutter shaft. The cutter fastenings, e.g. the chucking wedges 23, additionally act as fitting wedges, which assist the subsequently described flange-cutter block connection.

Figure 3:
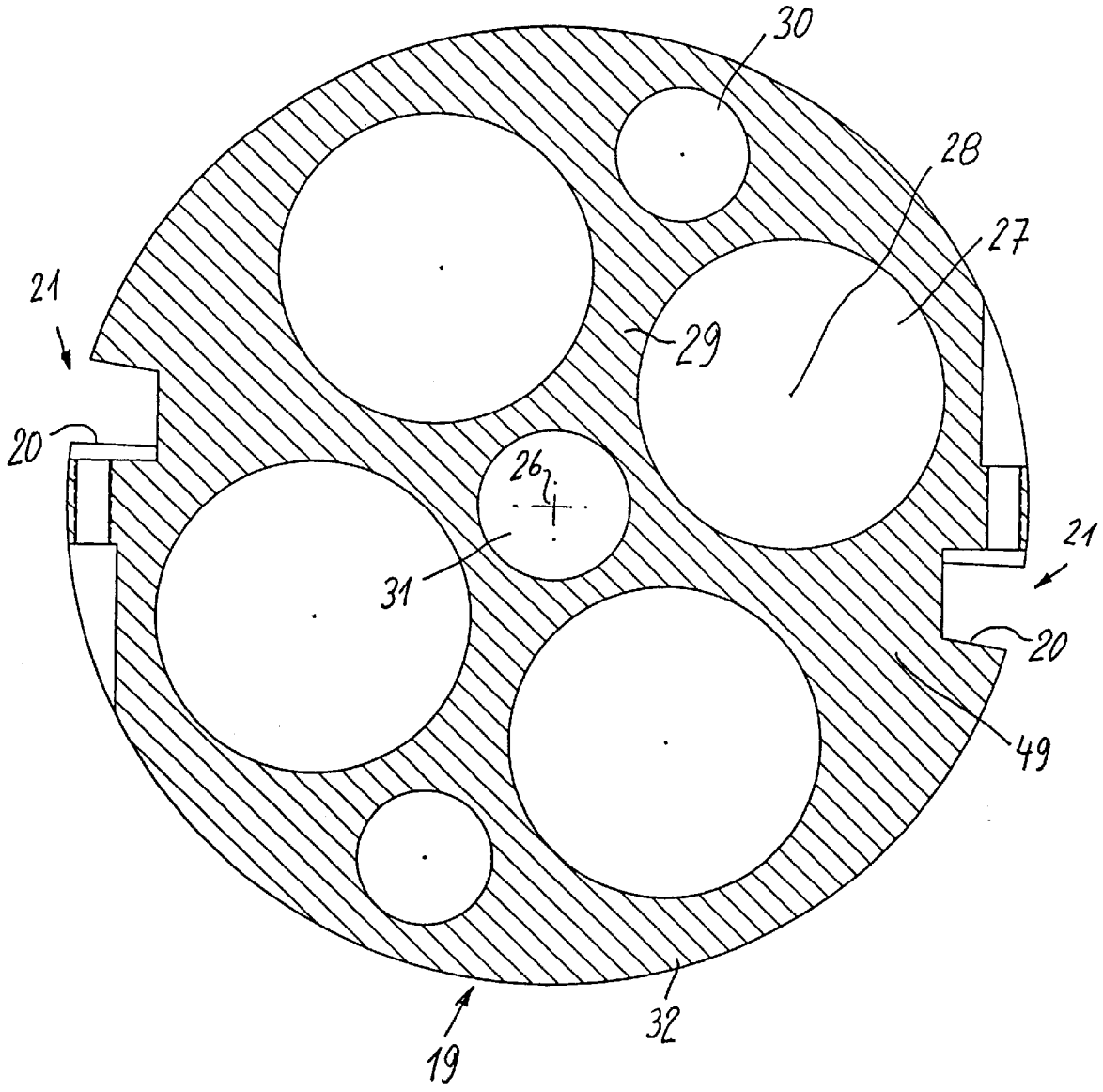
FIGS. 3 & 4 Sections along lines III and IV in FIG. 1.
Figure 4:
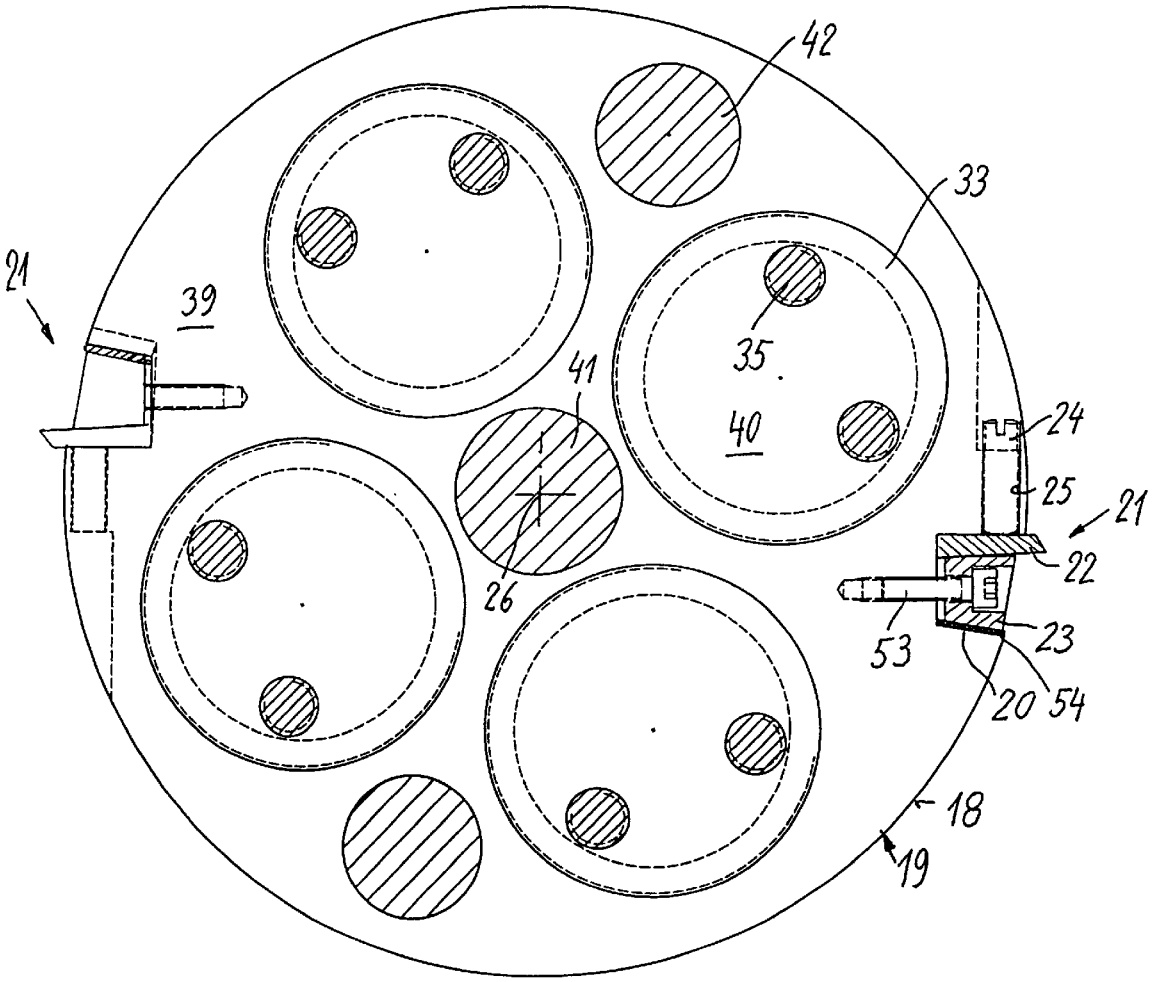

FIG. 3 also shows that the solid material cutter block has several longitudinally directed holes or bores, which run in each case parallel to the rotation axis 26 of the cutter shaft 13. There are four bores, which form bush recesses 27. They have a relatively large cross-section, e.g. between 25 and 40% of the cutter block diameter and are positioned in such a way that their axes 28 are on the angles of an imaginary square. The latter is so positioned that the cutter beams are roughly in the extension of the webs 29, which form between the bush recesses 27. FIG. 3 shows the recesses 20 somewhat laterally in the solid material gussets 49 forming between in each case two bush recesses 27, as can be gathered from the inclined configuration of the cutter beam recess 20. On average they are centrally located within the gusset. Displaced by 90° with respect to the gusset 49 are provided reamed bolt recesses 30, which are relatively close to the cutter block circumference. They are located in the extension of the webs 29 between the bush recesses 27, which are at right angles to the aforementioned webs.

As also the bush recesses extend relatively close to the circumference 18, in the centre of the cross-section is formed an area taken up by a central recess 31 and running coaxially to the rotation axis 26.

Thus, the cross-section of the cutter block 19 with its solid material portions left between the recesses is in the form of a wheel arranged around a central recess 31 with hub, four spokes (webs 29) and a circumferential, largely closed marginal area 32 in the manner of a tyre. The bush recesses 27 are regularly distributed around the rotation axis 26 and the smaller reamed bolt recesses on the one hand and the cutter recesses 20 on the other are in each case in the gaps between them, which leads to a substantially self-balanced structure, which is more particularly stable with respect to the main stresses (torsion and bending) and constitutes an almost ideal structure with respect to the mass moment of inertia and weight, which are incorporated into the bending.

The connection between the shaft end 14 and the cutter block 19 has three main features in the embodiment shown:

a) Steel bushes 33 are screwed into the bush recesses 27 and for this purpose in the interior of the recesses is provided a fine thread 34. The thread fit is such that it engages in low-backlash manner. In addition, the axial thread depth is dimensioned in such a way that the bushes are screwed in up to the thread interior, i.e. "on block". The thread is also secured by bonding in using a corresponding metal bonding agent. These features together with the strong axial tension, which is subsequently exerted by in each case two threaded bolts 35 screwed into the bushes, ensures that the latter are substantially non-detachably secured in the bush recesses. On introducing the bushes the material pairing is also advantageous. The individual threads are uniformly loaded in that the material of the cutter block (light metal alloy) has a roughly three times lower modulus of elasticity than the steel bush 33. Correspondingly, on loading, the cutter block threads engage uniformly on the external steel thread and transfer the initial stressing force applied over the entire thread length in roughly identical load proportions. This is consequently much more favourable than with a thread pairing of identical materials, in which the main load proportion is only transferred by means of the first threads.

Figure 5:
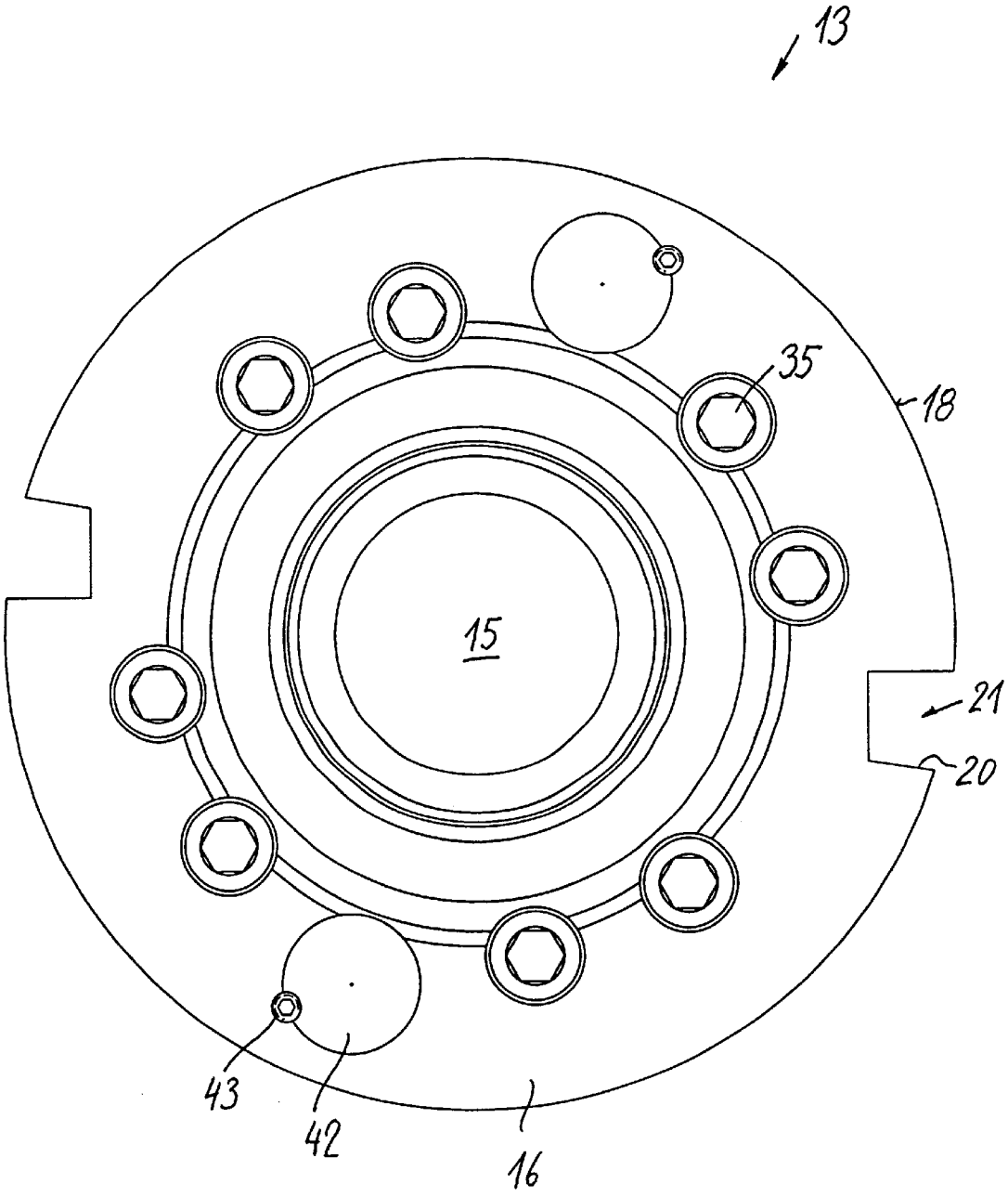
FIG. 5 A view considered from the direction of arrow V in FIG. 1.

The bushes have a jacket 36 and in the flange-facing area a thick bottom 37. Following the introduction of the bush recesses, in said bottom are made in matching manner with respect to the corresponding screw holes 38 in the flange two tapholes per bush, into which are screwed the powerful threaded bolts 35, whose heads are located in corresponding countersinks in the flange. The bolts are displaced towards the outer circumference instead of being centrally positioned with respect to the bushes. FIG. 5 shows that the in all eight screws screwed into the four bush recesses are located on a screw circle, which has a diameter of approximately ⅔ to ¾ of the circumferential diameter of the flange 16.

On introducing the bushes it is ensured that their bottom 37 is slightly set back with respect to the connecting plane 39 between flange 16 and cutter block 19, so that in the corresponding area 40 there is no direct contact with the flange 16. The tensile forces exerted by the threaded bolts 35 correspondingly press the flange 16 only onto the end face of the cutter block 19, so that the latter can adapt in ideal manner to the corresponding end face of the flange 16 made from harder material.

b) In its centre the flange 16 has a projecting spigot, which engages in a corresponding bore and ensures a precise centring during fitting.

c) Although the frictional forces resulting from the contact pressure produced by the threaded bolts is adequate for absorbing the high torques to be transferred, including the impact loads resulting from cutting, preferably there is additionally a positive connection, in that relatively thick reamed bolts 42 are fitted. They engage in a correspondingly precisely worked area of the reamed bolt recesses 30 and also entirely traverse the flange (FIG. 2), being secured by an additional headless locking screw 43.

The reamed bolts are also designed in such a way that in themselves they could transfer the forces which occur. Normally they are not loaded, because as a result of the nonpositive connection no movement tendencies occur between the cutter block and flange. Consequently they cannot be deflected by the strong alternating load occurring with synchronous cut length differences (acceleration twice and deceleration twice during each revolution).

Thus, the invention leads to a basic redundancy for the cutter shaft forming the most important part of a crosscutter. Any technically available light metal can be used for the cutter block, in place of the preferred aluminium alloy. As a result of the special connection method between the light metal structure of the cutter block and the shaft end 14 with steel journal 15 and flange 16, it is ensured that there is no inadmissibly high stressing at any point of the aluminium material. Thus, no plastic or inadmissibly high elastic deformations can occur.

What is claimed is:

1. A crosscutter for web material comprising:

at least one cutter shaft, including a cutter block made of light metal, extending axially over most of a cutting area and having a circumference, wherein the cutter block has several circumferentially distributed cylindrical holes continuing over the entire length of the cutter block;

at least one cutter blade secured to the cutter block at a cutter support;

cutter shaft end pieces having bearing means for the cutter shaft;

at least one shaft end piece manufactured separately from the cutter block and made of a high strength material, having at one side facing the cutter block a flange extended radially into the vicinity of the circumference of the cutter block; and connection means for connecting the cutter block to the flange, said connection means cooperating with and extending into said cylindrical holes.

2. The crosscutter according to claim 1, wherein the connection between the cutter block and the flange is as well an interlocking connection as a frictional connection.

3. The crosscutter according to claim 1, wherein the cutter shaft is provided with two cutters at the circumference.

4. The crosscutter according to claim 1, wherein steel bushes are inserted in the cutter block, into which at least one fixing screw is screwed, pressing the flange against the cutter block, to create frictional forces between the flange and the end face of the cutter block.

5. The crosscutter according to claim 4, wherein the bushes have no direct support on the flange.

6. The crosscutter according to claim 1, wherein the connection means includes fitting connection means co-operating with at least one of said circumferentially distributed circular cylindrical holes defining fitting holes, in which are inserted fitted holes of the flange.

7. The crosscutter according to claim 1, wherein the cutter support is axially extended over the cutter block, is directly cut into the light metal material of the cutter block, and extends over the flanges of the shaft ends.

8. The crosscutter according to claim 1, wherein the cutter block comprises a substantially cylindrical light metal body, the circumference being provided with two juxtaposed cutter supports which are directly shaped into the cutter block.

9. The crosscutter according to claim 1, wherein the holes include two groups of holes, fitting holes and bush holes, in which bushes for receiving straining screws are mounted.

10. A crosscutter according to claim 9, wherein the bush holes have a larger diameter than the fitting holes.

11. The crosscutter according to claim 9, wherein the cutter supports each include a recess of the cutter block, which is situated in an area between two of the bush holes.

12. The crosscutter according to claim 9, wherein in circumferential direction of the cutter block there is an alternation of one of the bush holes, one of the cutter supports and one of the fitting holes.

13. The crosscutter according to claim 1, wherein the flange has a spigot, which engages in a central recess in the cutter block.

14. The crosscutter according to claim 1, wherein the at least one cutter has a recess in the form of a cross-sectionally trapezoidal groove in the light metal cutter block defining two side walls and a bottom wall, the cutter being pressed onto adjusting screws projecting from one of the side walls by at least one chucking wedge, the other of said side walls being lined with a steel strip located between the chucking wedge and the material of the cutter block.

* * * * *